US007973676B2

(12) United States Patent
Meshkin et al.

(10) Patent No.: US 7,973,676 B2
(45) Date of Patent: Jul. 5, 2011

(54) ASSEMBLY AND METHOD FOR CONTROLLING ROAD SIGNAL INDICATORS

(75) Inventors: Mohammad Meshkin, Albany, CA (US); Houman Meshkin, Albany, CA (US); John Wade Carpenter, Metairie, LA (US)

(73) Assignees: Mohammad Meshkin, Albany, CA (US); Houman Meshkin, Albany, CA (US)

( * ) Notice: Subject to any disclaimer, the term of this patent is extended or adjusted under 35 U.S.C. 154(b) by 623 days.

(21) Appl. No.: 11/810,576

(22) Filed: Jun. 6, 2007

(65) Prior Publication Data

US 2008/0303695 A1 Dec. 11, 2008

(51) Int. Cl.
*G08G 1/095* (2006.01)
*G08G 1/07* (2006.01)
*G08G 1/097* (2006.01)

(52) U.S. Cl. ..... 340/908; 340/907; 340/921; 340/931

(58) Field of Classification Search ..... None
See application file for complete search history.

(56) References Cited

U.S. PATENT DOCUMENTS 3,729,706 A * 4/1973 Hein ..... 340/908
3,867,718 A * 2/1975 Moe ..... 340/908
5,900,826 A * 5/1999 Farber ..... 340/908
5,986,575 A * 11/1999 Jones et al. ..... 340/906
5,986,576 A * 11/1999 Armstrong ..... 340/908
6,052,067 A * 4/2000 Nuxoll ..... 340/908
6,072,407 A * 6/2000 Shin ..... 340/907
6,104,313 A * 8/2000 Boyd, II ..... 340/908.1
6,317,058 B1 * 11/2001 Lemelson et al. ..... 340/910
7,423,551 B1 * 9/2008 Sharrow ..... 340/908
7,633,408 B2 * 12/2009 Yingst et al. ..... 340/908
2006/0055558 A1 * 3/2006 Rohl ..... 340/907
2007/0067410 A1 * 3/2007 Mulligan ..... 709/217
2007/0222638 A1 * 9/2007 Chen et al. ..... 340/901
2007/0290887 A1 * 12/2007 Pleasanton ..... 340/908
2008/0198038 A1 * 8/2008 Yingst et al. ..... 340/908
2008/0252485 A1 * 10/2008 Lagassey ..... 340/907
2008/0258933 A1 * 10/2008 Diba ..... 340/907
2009/0058680 A1 * 3/2009 Benn ..... 340/908.1

* cited by examiner

*Primary Examiner* — Julie Lieu

(74) *Attorney, Agent, or Firm* — John W. Carpenter

(57) ABSTRACT

A method for controlling the movement of vehicles including removing a portable transmitter assembly and a portable receiving assembly from a vehicle, disposing the portable receiving assembly contiguous to an area where at least one vehicle travels, and illuminating at least one indicator on the portable receiving assembly with the portable transmitter assembly for controlling the movement of vehicles. An assembly for controlling the movement of vehicles includes a computer-readable medium.

12 Claims, 4 Drawing Sheets

ASSEMBLY AND METHOD FOR CONTROLLING ROAD SIGNAL INDICATORS

BACKGROUND OF THE INVENTION

1. Field of the Invention

Embodiments of the present invention relate generally to road signal indicators. More particularly, embodiments of the present invention relate to a method and system for controlling signal indicators (e.g., lights), which in turn would enable drivers of vehicles (e.g., cars, trains, and the like) to control or adjust the speed of the vehicles.

2. Description of the Background Art

Currently, when there is a need for traffic management, such as road closed (red), dangerous condition (yellow), resume speed (green), etc. The maintenance crew for roads, railroads, and the like, typically employ flashing lights, such as yellow lights. The lights are supported by the ground, on a pole or on a barricade, and are placed in position while the maintenance crews are working or after they have finished working. The color of the lights, while disposed on the side of a road or railroad track, may not be changed (e.g., by radio waves) at a moments notice as conditions for travel change, to control the speed or direction of traffic.

SUMMARY OF EMBODIMENTS OF THE INVENTION

Embodiments of the present invention provide an assembly for controlling the movement of vehicles. The assembly comprises a processing system including a computer, and a computer-readable medium including instructions executable by the computer. The computer-readable medium comprises one or more instructions for setting indicators on a portable receiving assembly, one or more instructions for communicating with a second computer, and one or more instructions for altering the set indicators on the portable receiving assembly. The computer-readable medium additionally comprises one or more instructions for providing an indication that the portable receiving assembly may be moved.

Embodiments of the present invention also comprise a method for controlling the movement of vehicles. The method includes removing a portable transmitter assembly and a portable receiving assembly from a vehicle, disposing the portable receiving assembly contiguous to an area where at least one vehicle travels, and illuminating at least one indicator on the portable receiving assembly with the portable transmitter assembly for controlling the movement of vehicles.

These provisions together with the various ancillary provisions and features which will become apparent to those artisans possessing skill in the art as the following description proceeds are attained by devices, assemblies, systems and methods of embodiments of the present invention, various embodiments thereof being shown with reference to the accompanying drawings, by way of example only and not by way of any limitation, wherein:

DETAILED DESCRIPTION OF EMBODIMENTS OF THE INVENTION

Figure 1A:
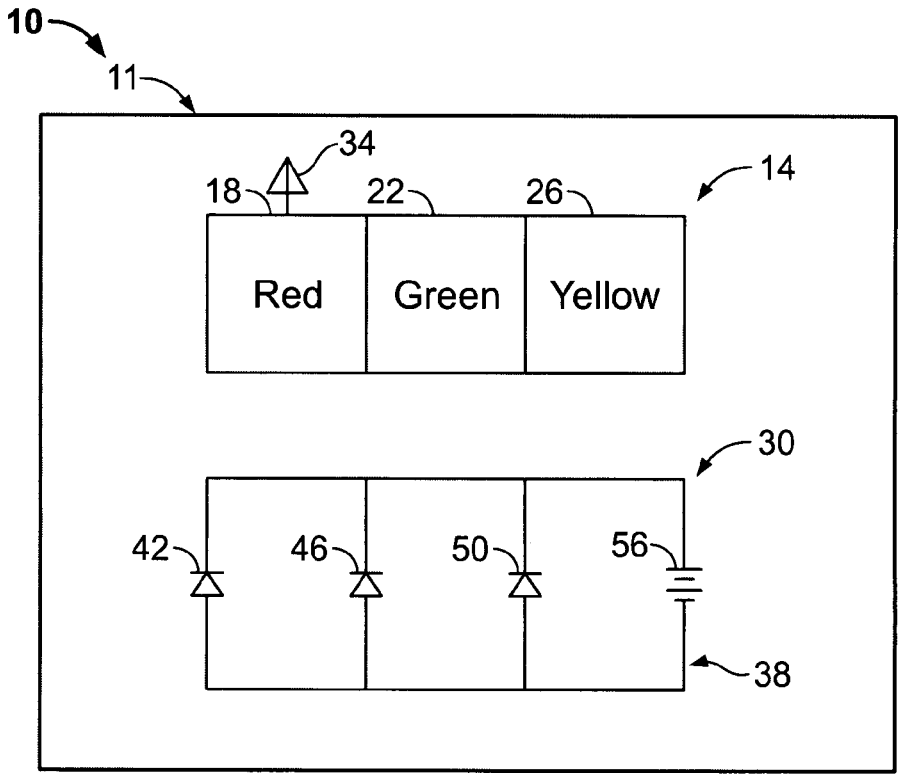
FIG. 1A is a diagram of a transmitting assembly which may be employed for various embodiments of the invention.

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Also in the description herein for embodiments of the present invention, a portion of the disclosure recited in the specification may contain material which is subject to copyright protection. Computer program source code, object code, instructions, text or other functional information that is executable by a machine may be included in an appendix, tables, Figures or in other forms. The copyright owner has no objection to the facsimile reproduction of the specification as filed in the Patent and Trademark Office. Otherwise all copyright rights are reserved.

A "computer" for purposes of embodiments of the present invention may be any device having a processor. By way of example only, a "computer" may be a mainframe computer, a personal computer, a laptop, a notebook, a blackberry, a microcomputer, a server, or any of the like. By further way of example only, a "computer" is merely representative of many diverse products, such as by way of example only: pagers, cellular phones, handheld personal information devices, stereos, VCRs, set-top boxes, calculators, appliances, dedicated machines (e.g., ATMs, kiosks, ticket booths, and vending machines, etc.), and any other type of computer-based product, and so forth. A "server" may be any suitable server (e.g., database server, disk server, file server, network server, terminal server, etc.), including a device or computer system that is dedicated to providing specific facilities to other devices attached to a network. A "server" may also be any processor-containing device or apparatus, such as a device or apparatus containing CPUs.

A "processor" includes a system or mechanism that interprets and executes instructions (e.g., operating system code) and manages system resources. More particularly, a "processor" may accept a program as input, prepares it for execution, and executes the process so defined with data to produce results. A processor may include an interpreter, a compiler and run-time system, or other mechanism, together with an associated host computing machine and operating system, or other mechanism for achieving the same effect. A "processor" may also include a central processing unit (CPU) which is a unit of a computing system which fetches, decodes and executes programmed instruction and maintains the status of results as the program is executed. A CPU is the unit of a computing system that includes the circuits controlling the interpretation of instruction and their execution.

A "computer program" may be any suitable program or sequence of coded instructions which are to be inserted into a computer, well known to those skilled in the art. Stated more specifically, a computer program is an organized list of instructions that, when executed, causes the computer to behave in a predetermined manner. A computer program contains a list of ingredients (called variables) and a list of directions (called statements) that tell the computer what to do with the variables. The variables may represent numeric data, text, or graphical images.

A "computer-readable medium" for purposes of embodiments of the present invention may be any medium that can contain, store, communicate, propagate, or transport a program (e.g., a computer program) for use by or in connection with the instruction execution system, apparatus, system or device. The computer-readable medium can be, by way of example only but not by limitation, an electronic, magnetic, optical, electromagnetic, infrared, or semiconductor system, apparatus, system, device, propagation medium, or computer memory.

Figure 1B:
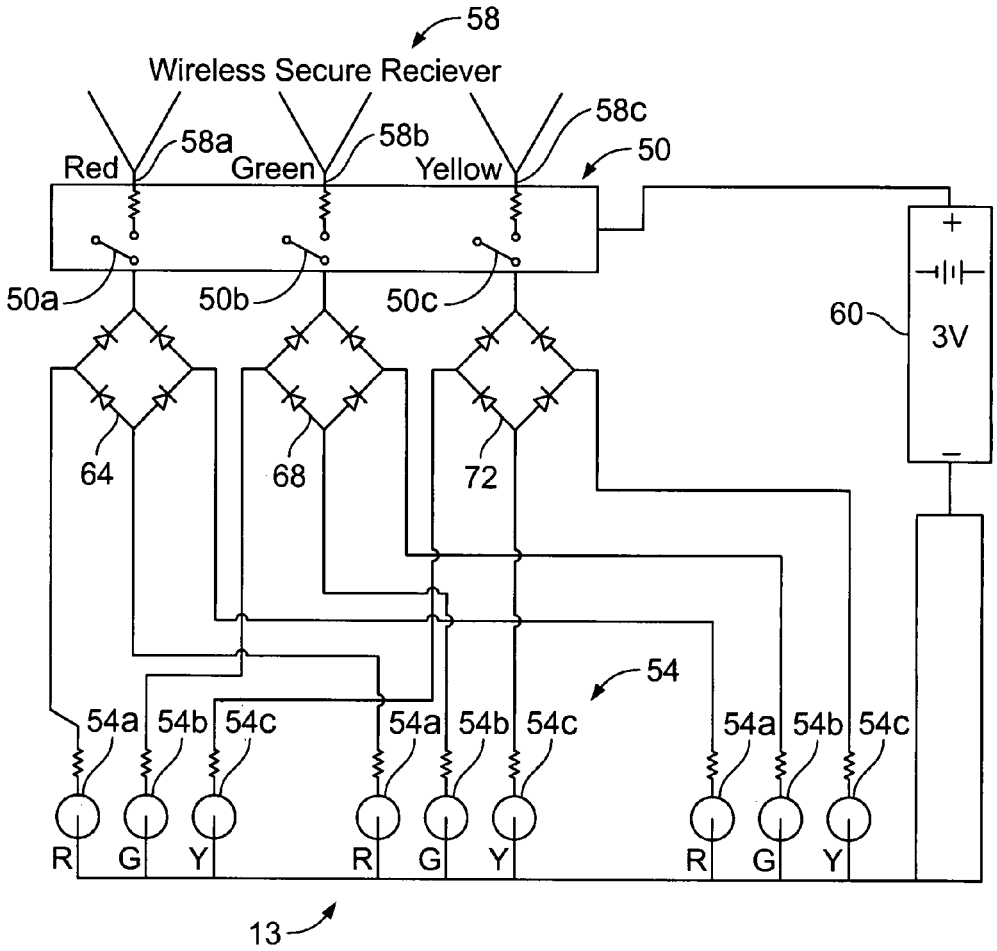
FIG. 1B is a diagram of an assembly which may be employed for various embodiments of the invention.

Referring in detail now to FIGS. 1A and 1B, there is seen an embodiment of the invention, which includes a system, generally illustrated as 10, for controlling signal indicators (e.g., lights), which in turn enable drivers of vehicles (e.g., cars, trains, and the like) to control or adjust the speed of the vehicles. The system 10 broadly comprises a transmitting assembly 11 having at least one button or switch assembly (or the like), generally illustrated as 14. Preferably, the button assembly 14 comprises buttons 18, 22 and 26.

The buttons 18, 22 and 26 typically comprise an overlying semi-opaque or translucent button structure such that when the undersides of the respective structures are illuminated by any suitable lighting assembly, such as lighting assembly 30, the respective button structures illuminate the color of the button structures. In a preferred embodiment of the invention, the colors of the overlying structures for buttons 18, 22, and 26 are red, green, and yellow, respectively. When the bottom or undersides of buttons 18, 22 and 26 are illuminated, the respective colors of buttons 18, 22 and 26 are preferably red, green, and yellow. In an embodiment of the invention, the color illuminating from any particular button is determined by the color of the structure of the button.

The transmitter assembly 11 also includes an antenna 34 for transmitting appropriate signals in accordance with the particular button (i.e., the respective color of the button) which is depressed. The character of any signal transmitted from depressing any button depends on the color of the button depressed. By way of example only, if red button 18 is depressed, the signal emanating from antenna 34 as a result of depressing red button 18 would be different and/or distinguishable from the signal emanating from antenna 34 as a result of depressing yellow button 26.

Lighting assembly 30 includes at least one light emitting diode block 38. In an embodiment of the invention, diode block 38 includes light emitting diodes 42, 46 and 50. Light emitting diodes 42, 46 and 50 may produce any suitable colored light, preferably red, green and yellow. In an embodiment of the invention where colored buttons (i.e., red button 18, green button 22 and yellow button 26) are employed, the LEDs produce a white light so that the colored buttons produce the desired colors of red, green and yellow. In another embodiment of the invention, the buttons may be clear (e.g. clear plastic) so that the color of the light emanating from the respective clear buttons is the color of the LEDs (i.e., red, green and yellow). The LEDs may be powered by any suitable battery having any suitable power, such as ±3 volt battery 56 in FIG. 1A. The voltage of the battery 56 is not to be limited to a 3 volt battery. As indicated, the battery 56 may have any suitable voltage. Thus, the type of battery is may possess any type of battery as the battery's power may be based on any source of electrical power generation, including solar based energy.

While the diode block 38 has been described as having light emitting diodes 42, 46 and 50, it is to be understood that the diode block 28 may include only one light emitting diode which is capable of providing one or more colors. Thus, the single light emitting diode may provide all three colors R/Y/G. In an embodiment of the invention, the number of light emitting diodes may vary from 1 or more diodes. By way of example only, the diode block 38 may comprise 4 LEDs whose colors may sequentially go from pink to bright red, and further sequentially move as though they are in direct series (i.e., in direction of an arrow). As indicated, the colors are not to be limited to the three colors R/Y/G Thus, in an embodiment of the invention, the colors may be any colors and may be for purposes other than controlling the movement of vehicle. Further more, the diode block 38 may comprise a single LED (e.g., a 12 v LED) which is a computer programmable LED and capable of producing as many colors as desired (i.e., 16 million colors).

In a preferred embodiment of the invention and as previously indicated, the transmitter system 11 illustrated in FIG. 1A includes three distinct switches (i.e., buttons 18, 22 and 26) marked as the colors of a desired indicator, more particularly as the previously mentioned colors, red, green, and yellow. Closing of the distinct switches or depression of buttons 18, 22 and 26 is for causing the lights of a receiver assembly to illuminate a color which corresponds to the colors of the LEDs resulting from depression of buttons 18, 22, and 26.

The system 10 also broadly comprises a receiver assembly 13 for receiving and processing a wireless signal produced or transmitted by the transmitter system 11. Signals caused to be sent by the depression of red button 18, green button 22 and yellow button 26 are for respectively causing red, green, and yellow lights of the receiver assembly 13 to be illuminated, as will be more specifically described hereafter.

As shown in FIG. 1B, the receiver assembly 13 includes a receiver indicator-control (e.g., light-control) assembly 50 which is coupled to a receiver light assembly 54. The receiver indicator-control assembly 50 has at least one antenna 58 for receiving signals transmitted off of or from antenna 34 of the transmitter system 11. In a preferred embodiment of the invention, the receiver light-control assembly 50 includes antenna 58*a*, 58*b* and 58*c*. Antenna 58*a* receives signals associated with red button 18 of the transmitter system 11 for opening and closing switch 50*a* which turns "on" or "off" red lights 54*a* associated with the receiver light assembly 54. Similarly antennas 58*b* and 58*c* receive respective signals associated with green and yellow buttons 22 and 26 of the transmitter system 11 for respectively opening and closing switch 50*b* and 50*c* which respectively turn "on" or "off" green and yellow lights 54*b* and 54*c* associated with the receiver light assembly 54. Power is provided to the receiver light-control assembly 50 and to the receiver light assembly 54 by battery 60. When switch 50*a* is closed, current passes from the light-control assembly 50 through Wheatstone bridge 64 and through the illustrated conductors to illuminate one or more red lights 54*a*. Similarly, when switches 50*b* and 50*c* are closed, current passes from the light-control assembly 50 and respectively through Wheatstone bridges 68 and 72 and through the illustrated conductors to illuminate one or more green and yellow lights 54*b* and 54*c*, respectively.

As previously indicated, illumination of yellow light(s) 54*c* in the receiver light assembly 54 indicates a cautious condition (e.g., driving on a road with caution), and illumination of green light(s) 54*b* indicates an optimal condition (e.g., driving on a road with optimal road conditions). Illumination of red light(s) 54*a* refers to a hazardous condition (e.g., such as a road which is closed). A hazardous condition may be caused by ice, water, or fog.

The receiver assembly 13 is preferably a portable assembly that may be supported by a pole (or by any other device) whose structure may be telescopically extended or collapsed for storage convenience. The receiver assembly 13 including it associated pole may be easily removed from a vehicle. Thus, in the event that it becomes desirable or necessary to control the speed of traffic on a highway, or to control the speed of a train on railroad tracks, a person may easily remove the receiver assembly 13 (as well as the transmitting assembly 11) from a vehicle and dispose the speed-controlling assemblies at a desired location contiguous to a highway or railroad tracks. The assembly 10 (i.e., the transmitting assembly 11 in combination with the receiver assembly 13) may include an anti-theft indicator or a non-operable indicator. Either indicator may be any suitable indicator, such as one that would transmit a signal to any suitable location or device in the event of a theft attempt or non-operation of any feature of the receiver assembly 13.

In addition to the previously mentioned indicators (e.g., the red, green, and yellow lights), the receiver assembly 13 may include one or more other indicators. By way of example only, the receiver assembly 13 may include light(s) for illuminating other directional indicators for controlling traffic, such as the arrow 70 in FIG. 3, whose purpose would be for any suitable purpose such as for directing traffic off to a mandatory chain installation area contiguous to a road or highway.

Figure 2:
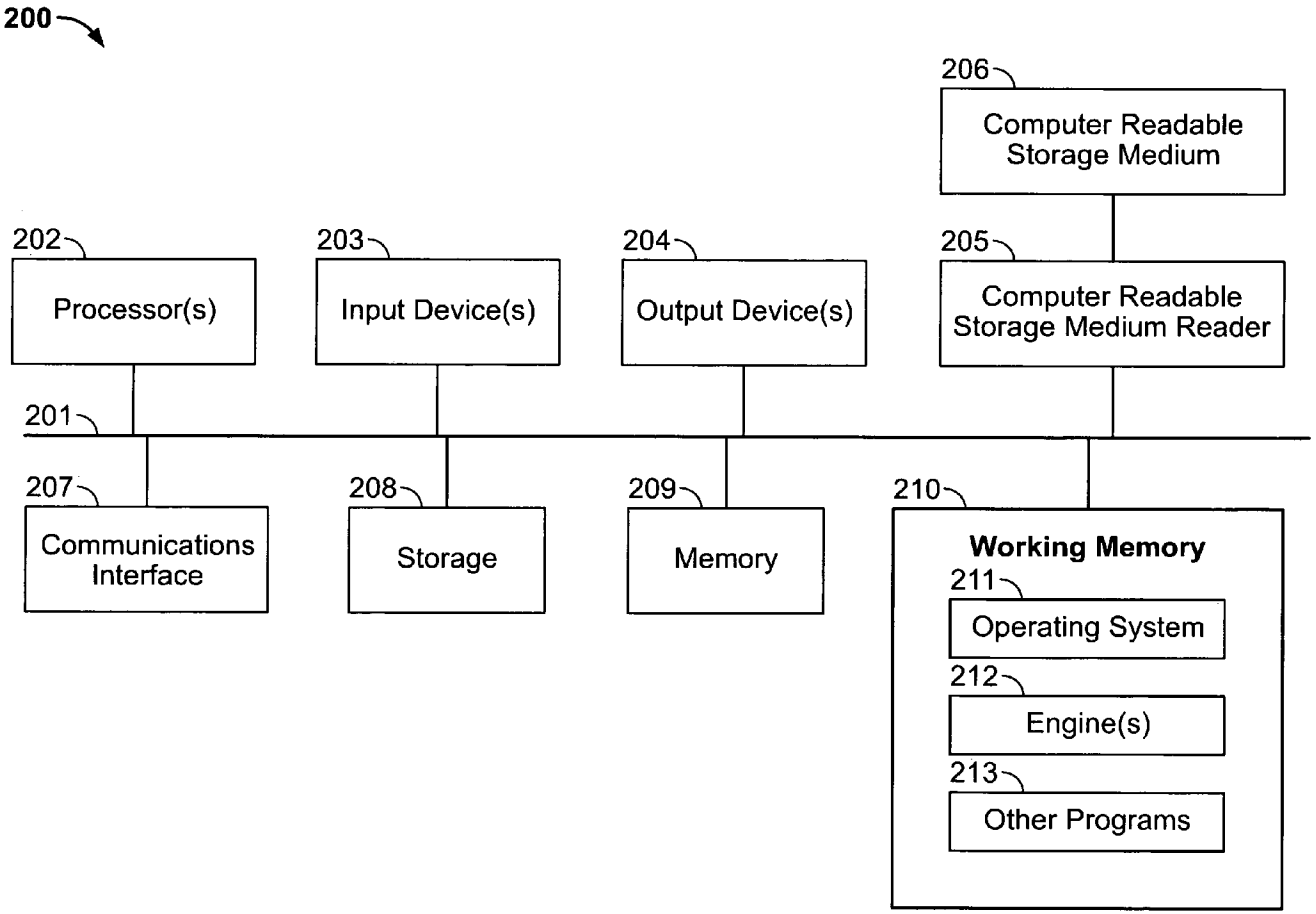
FIG. 2 is a diagram of an exemplary computer assembly which may be employed to implement embodiments of the present invention.

Embodiments of the present invention may be further or alternatively implemented by a computer system. The computing system may be any suitable computer system, such as the exemplary computing system 200 illustrated in FIG. 2 and which may be employed to implement embodiments of the present invention. While other alternatives might be utilized, it will be presumed for clarity sake that components of the systems and procedures illustrated herein may be implemented in hardware, software or some combination by one or more computing systems consistent therewith, unless otherwise indicated.

Computer system 200 comprises components coupled via one or more communication channels (e.g. bus 201) including one or more general or special purpose processors 202, such as a Pentium®, Centrino®, Power PC®, digital signal processor ("DSP"), and so on. System 200 elements also include one or more input devices 203 (such as a mouse, keyboard, microphone, pen, and so on), and one or more output devices 204, such as a suitable display, speakers, actuators, and so on, in accordance with a particular application.

Computer system 200 also includes working memory 210, a computer readable storage media reader 205 coupled to a computer readable storage medium 206, such as a storage/memory device or hard or removable storage/memory media. System 200 may further include storage 208, and memory 309, which may include hard disk variants, floppy/compact disk variants, digital versatile disk ("DVD") variants, smart cards, partially or fully hardened removable media, read-only memory, random access memory, cache memory, and so on, in accordance with the requirements of a particular implementation. One or more suitable communication interfaces 207 may also be included, such as a modem, DSL, infrared, RF or other suitable transceiver, and so on for providing inter-device communication directly or via one or more suitable private or public networks or other components that can include but are not limited to those already discussed.

Working memory 210 may include operating system ("OS") 211, engine(s) 212 and other programs 213. Working memory 210 components may also include one or more of application programs, mobile code, data, and so on for implementing system components that might be stored or loaded therein during use. The particular OS may vary in accordance with a particular device, features or other aspects in accordance with a particular application (e.g., using Windows, WindowsCE, Mac, Linux, Unix or Palm OS variants, a cellular phone OS, IOS or some other proprietary OS, and so on). Various programming languages or other tools can also be utilized, such as those compatible with C variants (e.g., C++, C#), the Java 2 Platform, Enterprise Edition ("J2EE") or other programming languages in accordance with the requirements of a particular application. Such working memory components can, for example, include one or more of applications, add-ons, applets, custom software and so on for conducting but not limited to the examples discussed elsewhere herein. Other programs 312 may, for example, include one or more of security, compression, synchronization, backup systems, groupware code, and so on, including but not limited to those discussed elsewhere herein.

When implemented in software (e.g. as an application program, object, agent, downloadable, servlet, and so on in whole or part), a document system or other component may be communicated transitionally or more persistently from local or remote storage to memory (SRAM, cache memory, etc.) for execution, or another suitable mechanism can be utilized, and elements can be implemented in compiled or interpretive form. Input, intermediate or resulting data or functional elements may further reside more transitionally or more persistently in a storage media, cache or other volatile or non-volatile memory, (e.g., storage device 308 or memory 309) in accordance with a particular application.

Figure 3:
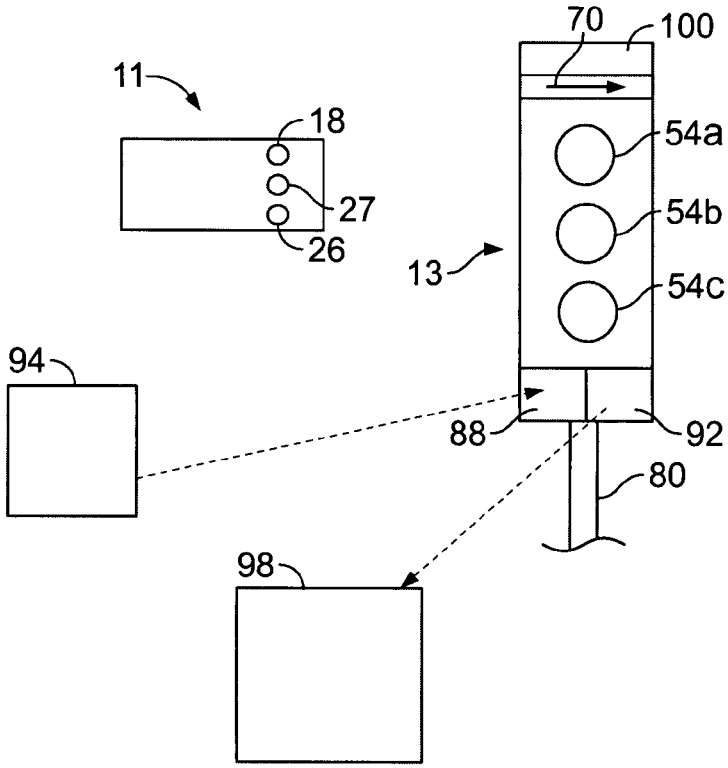
FIG. 3 is a diagram of another embodiment of the invention.

Referring now to FIG. 3 for other embodiments of the present invention, there is illustrated the transmitting assembly 11 and the receiver assembly 13. The receiver assembly 13 may be supported by a pole 80 which may be removable disposed on any suitable support, such as the ground. There is also illustrated in FIG. 3 computers 94 and 98. Computer 94 is preferably a portable computer which may be carried by any person who has the desire to control operation of the receiver assembly 13. Thus, computer 94 may control the operation of the receiver assembly 13 as an alternative to transmitting assembly 11, or computer 94 may operate in combination with the transmitting assembly 11.

For explaining an embodiment of the invention, it is assumed that the computer 94 will operate in combination with the transmitting assembly 11. After the receiving assembly 13 has been set and is operating as desired, computer 94 may be used to place a message in box 100. The message could explain why the red light 54*a* or yellow light 54*c* has been illuminated (e.g., fog on the highway ahead). The receiving assembly 13 may include a processor 88 and a transmitter 92. The processor 88 may continually monitor and furnish operation conditions to another computer 98 which may be a central computer at another location (e.g., a highway patrol main office). The processor 88 may be used to establish the exact location (e.g., through a GPS) of the receiving assembly 13 and furnish this information via transmitter 92 to the computer 94. As previously suggested, the processor 88 may send a message to computer 98 in the event of an attempt theft or a malfunction of the receiving assembly 13. The computers 94 and 98, as well as the processor 88, may possess the necessary source code, computer programs, or computer readable medium for accomplishing their desired objects. The radio frequency of all signals transferred in accordance with operation of the embodiments of the invention, would have to be set so that no one could transmit any signals with a radio frequency that would conflict with the radio frequency transferred in accordance with operation of embodiments of the present invention.

Figure 4:
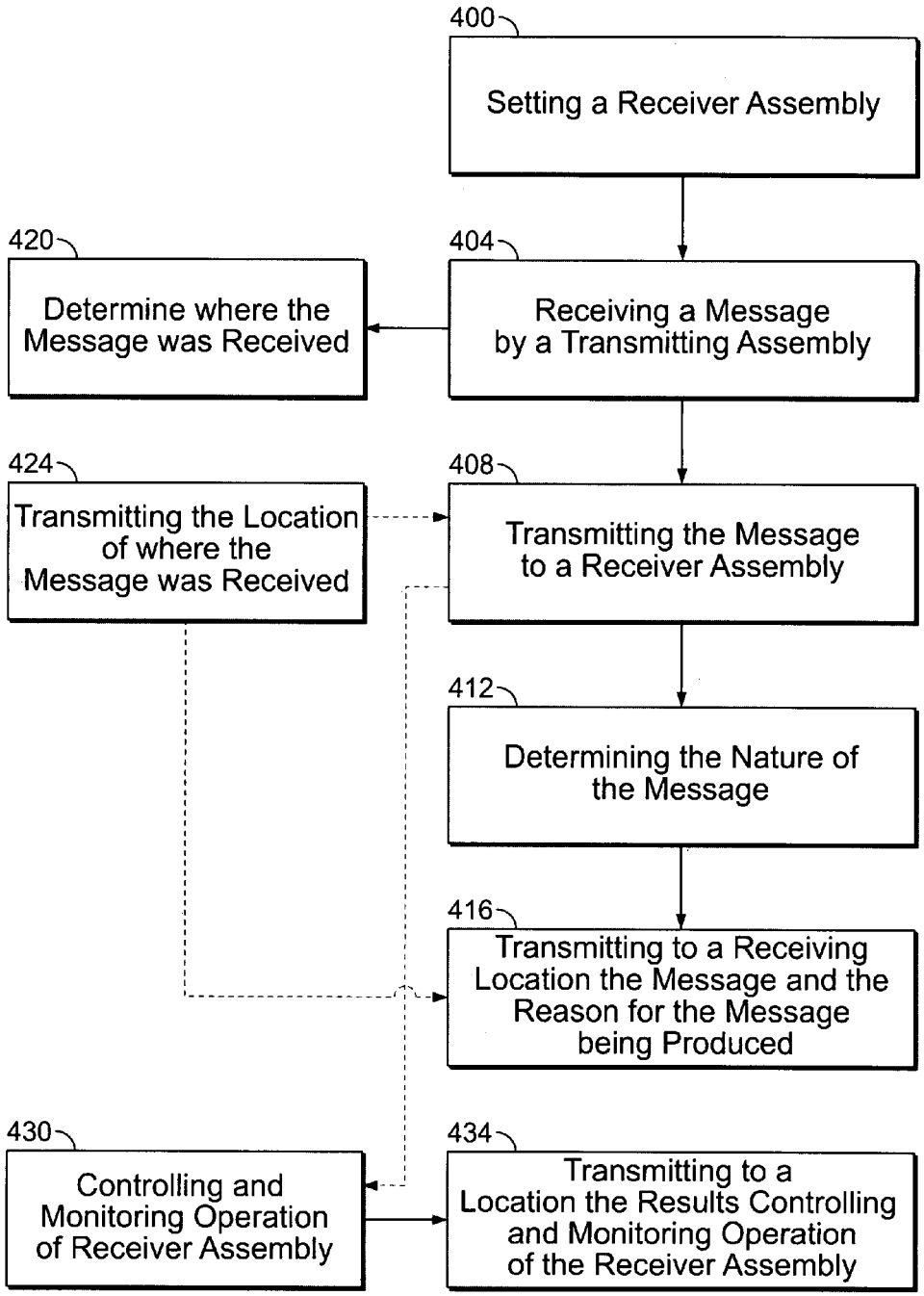
FIG. 4 is a block-flow diagram of operation of the invention partly under computer control.

Referring now to FIG. 4 is seen a block-flow diagram of operation of the invention partly under computer control. Block 400 represents the setting of a receiver assembly in accordance with desired operation of the receiver assembly. A transmitting assembly receives a message [e.g., explaining why an indicator (e.g., a light) is indicating (e.g., a light illuminating)], as shown by block 404. As represented by block 408, the message may be transmitted to a receiver assembly, where in an embodiment of the invention, the nature [e.g., an indicator is producing the message (e.g., a light is illuminted)] of the message is determined. The message and the reason (e.g., fog and/or snow on the highway ahead) for the message is transmitted (as represented by block 416) to a location (e.g., a computer in another location, such as the main or home office).

Continuing to refer to FIG. 4 for another embodiment of the invention, in addition to the transmitting assembly receiving a message, as shown by block 404, the location of where the message was received may be determined, as shown by block 420. As represented by block 424, the location of the message is transmitted to the location identified in block 416, or alternatively, the location is transmitted (see dashed line) to the transferring step in block 408 where the location is subsequently transmitted (along with the nature identified in block 412) to the location of the message identified in block 416. As an alternative to transferring the location to the receiver assembly identified in block 408, the location may be transmitted directly (see dashed lines) to the location identified in block 416. In a further embodiment of the invention and as illustrated by the dashed lines, the receiver assembly of block 408 may be monitored and/or controlled as shown by block 430, and the results from the monitoring and/or controlling the receiving assembly is transmitted to a location (which may be same location identified in block 416. For all embodiments of the inventions illustrated in FIG. 4, the results and/or information produced by the various steps are outputted.

Reference throughout the specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Further, at least some of the components of an embodiment of the invention may be implemented by using a programmed general purpose digital computer, by using application specific integrated circuits, programmable logic devices, or field programmable gate arrays, or by using a network of interconnected components and circuits. Connections may be wired, wireless, by modem, and the like.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. A method for controlling the movement of vehicles comprising the steps of:

(a) carrying a portable transmitting assembly to a desired location where at least one vehicle travels, said transmitting assembly including a computer;

(b) transporting a portable receiving assembly with a vehicle to the desired location;

(c) disposing the portable receiving assembly contiguous to the desired location;

(d) depressing manually by an operator a button on the portable transmitting assembly for illuminating a light in the portable receiver assembly;

(e) entering manually a message into the portable transmitting assembly to cause the portable transmitting assembly to receive the message;

(f) entering manually into the portable transmitting assembly the reason why the message was entered; and (g) transmitting the manually-entered message and the manually-entered reason with the portable transmitting assembly to a message box in the portable receiver assembly; and (h) displaying both the manually-entered message and the manually-entered reason on the portable receiver assembly.

2. The method of claim 1 additionally comprising establishing a location of said portable receiving assembly with a processor.

3. The method of claim 1 additionally comprising redisposing the portable transmitter assembly and the portable receiving assembly in the same or second vehicle.

4. The method of claim 1 wherein said portable receiving assembly additionally includes a processor and a transmitter.

5. The method of claim 4 additionally comprising transmitting the manually-entered message and manually-entered reason from the transmitter of the portable receiver assembly to a receiving location.

6. The method of claim 5 wherein said receiving location comprises a highway patrol office.

7. The method of claim 5 additionally comprising determining at said receiving location the location of the portable receiving assembly.

8. The method of claim 1 wherein said reason comprises an indication that there is fog on a highway ahead.

9. The method of claim 1 wherein said reason comprises an indication that there is snow on a highway ahead.

10. The method of claim 5 additionally comprising transmitting a computer message by a computer for storage in a message box of the portable receiver assembly.

11. The method of claim 10 additionally comprising transmitting with the computer a reason why the computer message was transmitted for storage in the message box of the portable receiver assembly.

12. The method of claim 11 additionally comprising transmitting to the receiving location, along with the manually-entered message and manually-entered reason, the computer message and the reason why the computer message was transmitted.

* * * * *